United States Patent [19]

Sasaki et al.

[11] Patent Number: 4,921,038

[45] Date of Patent: May 1, 1990

[54] PROCESS FOR PREPARING MOLD FOR INVESTMENT CASTING

[76] Inventors: Nobuyoshi Sasaki, 18-13, 1-chome, Aobadai, Midori-ku, Yokohama-shi, Kanagawa; Susumu Baba, 25-602, 2-chome, Wakabadai, Asahi-ku, Yokohama-shi, Kanagawa, both of Japan

[21] Appl. No.: 353,956

[22] Filed: May 19, 1989

[30] Foreign Application Priority Data

May 20, 1988 [JP] Japan ..... 63-122054

[51] Int. Cl.[5] ..... B22C 9/04; B22C 9/10; B22C 1/18

[52] U.S. Cl. ..... 164/516; 164/35; 164/28; 164/527; 164/369

[58] Field of Search ..... 164/28, 34, 35, 36, 164/12, 16, 516, 518, 527, 369

[56] References Cited

U.S. PATENT DOCUMENTS 4,712,605 12/1987 Sasaki et al. ..... 164/516
4,834,165 5/1989 Egoshi et al. ..... 164/369

FOREIGN PATENT DOCUMENTS 63-171245 7/1988 Japan ..... 164/369

*Primary Examiner*—Kuang Y. Lin
*Attorney, Agent, or Firm*—Laff, Whitesel, Conte & Saret

[57] ABSTRACT

A process for preparing an investment casting mold is provided. A kneaded compound composed of an aggregate and an organic binder is cast into a core molding mold to be solidified therein to produce a core matrix which is impregnated with a heat resisting binder to an appropriate depth followed by coating with a wax, whereby a core mold is formed. The core mold is placed in position within a lost model molding mold followed by injection of a lost model forming material. A slurry and stucco particles are alternately coated over the lost model for plural times to form a refractory layer. The lost model is removed to obtain a final mold which is baked to effect simultaneous baking of the core mold and the refractory layer, the former forming the mold core and the latter forming the exterior shell mold.

4 Claims, 4 Drawing Sheets

PROCESS FOR PREPARING MOLD FOR INVESTMENT CASTING

BACKGROUND OF THE INVENTION

1. Field of the Invention

The present invention relates generally to the investment casting, and particularly to a process for preparing an investment casting mold composed of an inner mold core and an outer shell mold baked simultaneously at a single baking step.

2. Related Art Statement

A ceramic mold core used or assembled within a mold for an investment casting process should have a strength which is high enough to withstand the injection molding of a wax model and having a strength at high temperature which is sufficient for retaining its inegrity under a high temperature environment, during the sintering and/or casting steps. Prior art cores conventionally used for such purposes are molded from aggregates, such as those containing alumina, zirconia or fused silica. Then the thus molded cores are burned or sintered singly. However, such a process leads to a low producibility in production of cores and lowers the overall operation efficiency.

A further disadvantage of the conventional process is that the sintered core molds used therein are hard to demolish after use. They cannot be removed from the cast product by the application of physical vibration or impact. Thus, cumbersome and inefficient operations are required for the removal of such core molds, leading to increase in production cost.

OBJECTS AND SUMMARY OF THE INVENTION

An object of this invention is to provide a process for preparing an investment casting mold having a thermal strength which is high enough to withstand the injection molding operation during the step of molding a wax model and a thermal strength which is sufficient to withstand a high temperature during the mold baking step and the molten metal casting step.

Another object of this invention is to provide a process for preparing such an investment casting mold containing therein a core mold which can be used without being sintered so that it is demolished by physical means in order to be easily demolished after use.

A further object of this invention is to provide a process for preparing an investment casting mold having a high production efficiency and contributes reduction in overall production cost of the investment casting process.

The aforementioned objects in view, the present invention provides a process for preparing an investment casting mold comprising the steps of:

(a) kneading an aggregate with an organic binder;

(b) casting the kneaded compound composed of the aggregate and the organic binder into a core molding mold to be solidified therein to produce a core matrix;

(c) impregnating a heat resisting binder from the surface of said core material;

(d) coating said core matrix impregnated with said heat resisting binder at said step (c) with a wax to form a core mold;

(e) placing said core mold in position within a lost model molding mold and then injecting a lost model forming material into said lost model molding mold to form a lost model surrounding said core mold;

(f) coating a slurry and stucco particles alternately for plural times over said lost model to form a refractory layer which is then dried;

(g) allowing said lost model to vanish so as to obtain a final mold; and (h) baking said final mold composed of said core mold and said refractory layer simultaneously.

In a preferred embodiment, the aggregate is silicious sand and the organic binder is a phenolic resin, and the baking is effected under controlled temperature.

DESCRIPTION OF PREFERRED EMBODIMENT

An embodiment of this invention will now be described with reference to FIGS. 1 to 3.

At the first step of the process of this invention, an aggregate and an organic binder are kneaded together. One example of the aggregate which may be used in this invention is silicious sand. Preferable silicious sand has a particle size corresponding to #7 grade stipulated in JIS G-5901(1954). Zirconia, alumina or fused silica may also be used as the aggregate.

An example of preferred organic binder is a phenolic resin which is added little by little to the aggregate in an amount of about 5 wt%, based on the weight of the aggregate, followed by kneading (Step 100).

Figure 2A:
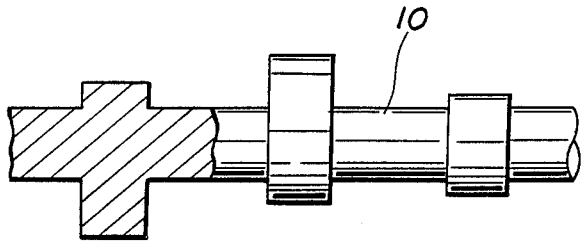
FIGS. 2(A) to 2(G) are illustrations showing the steps of preparing the investment casting mold according to this invention.

In the next step (Step 102), the kneaded compound composed of the aggregate and the organic binder is fed in a mold (not shown) for shaping a mold core so that a core matrix 10 (see FIG. 2(A)) is prepared.

It is preferable to use a phenolic resin as the organic binder, since the phenolic resin is cured by the heat and pressure applied during the core molding step 102 so that the core matrix 10 is solidified to have a sufficient integrity. Curing of the phenolic resin may be promoted by additional heating from the outside of the mold for molding the core matrix 10.

Figure 1:
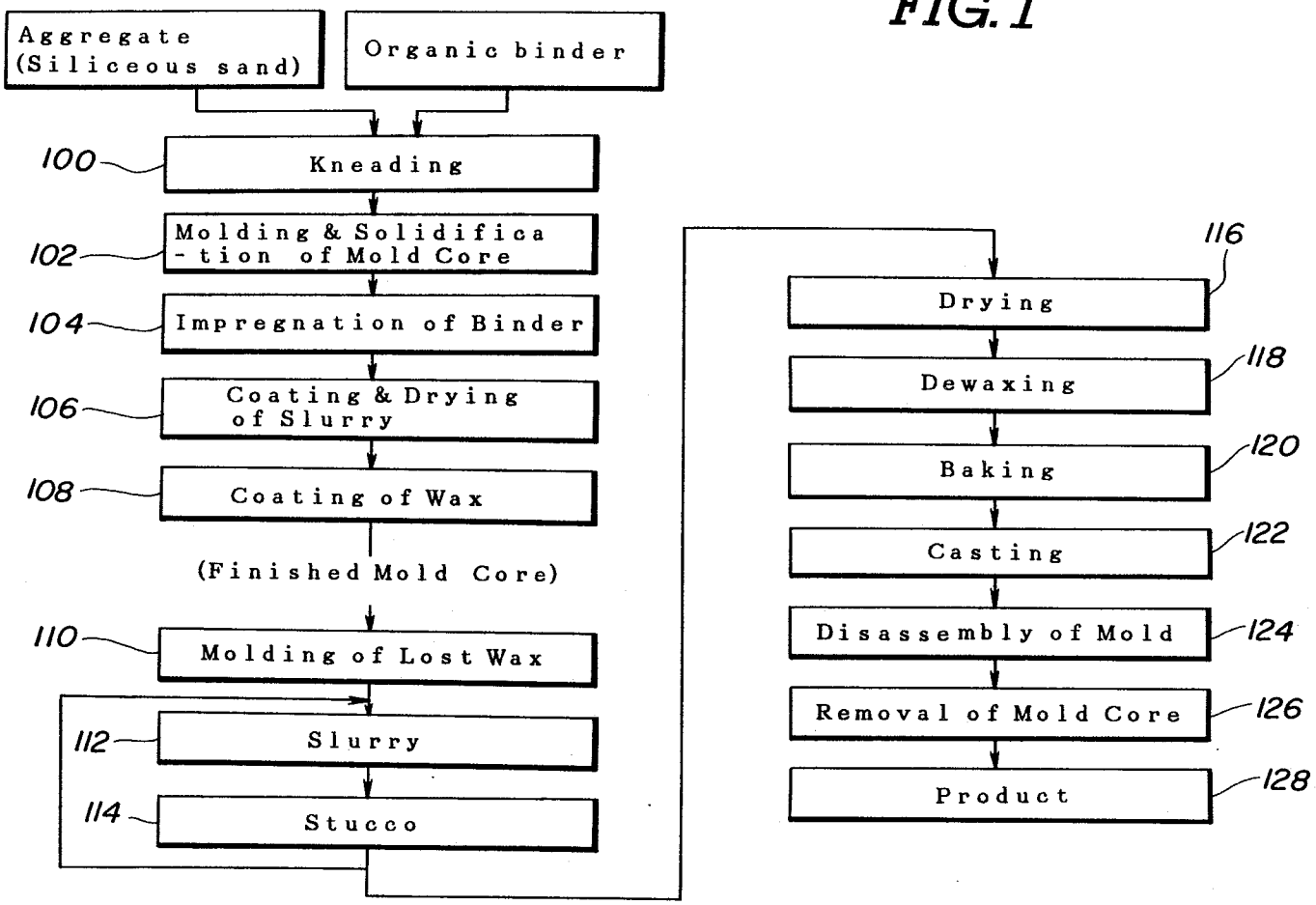
FIG. 1 is a flow diagram showing the process for preparing the investment casting mold according to this invention.
Figure 2B:
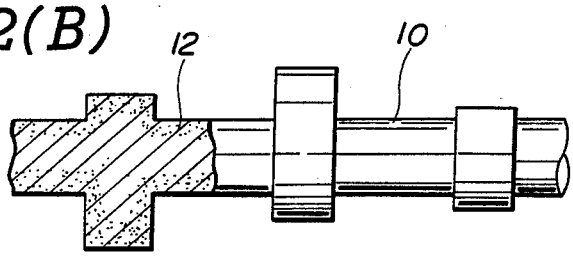

The next step is the step of dipping the core matrix 10 into a bath containing a heat resisting inorganic binder so that the core matrix 10 is impregnated with the heat resisting inorganic binder (Step 104 in FIG. 1; FIG. 2(B)). Preferable examples of the heat resisting inorganic binder used in this step 104 are ethyl silicate and sodium silicate. A binder containing layer 12 is formed by this step 10 so that the heat resisting inorganic binder impregnates from the surface of the core matrix 10 to a proper depth for increasing the strength of the core matrix 10 at a high temperature environment. Although the bonding strength of the organic binder admixed at the Step 100 is abruptly decreased at high temperature, the core matrix impregnated with the heat resisting inorganic binder in this Step 104 has a strength which is high enough for retaining its integrity under high temperature environment of the subsequent baking step.

Figure 2C:
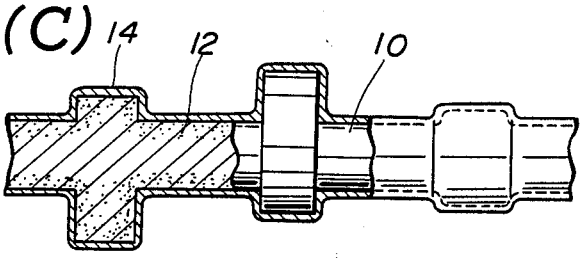

The core matrix impregnated with the heat resisting binder is coated with a slurry (Step 106; FIG. 2(C)) which desirously contains a binder and a filler. An example of the slurry used in this Step 106 has the following composition of:

Ethyl silicate: 50 wt%

Zircon Flour #350: 50 wt%

The slurry may be coated by the dipping process wherein the core matrix 10 is dipped into a slurry container, or by the spraying method wherein the slurry is sprayed onto the surface of the core matrix 10, or by the electrostatic coating method wherein an electrostatic potential is applied between the core matrix 10 and a sprayer nozzle to deposite the slurry mists onto the surface of the core matrix 10. For instance, when the slurry is coated by the dipping process, the core matrix 10 is dipped in the slurry container for about 60 seconds. Prior to coating with the slurry at the Step 106, the core matrix 10 impregnated with the heat resisting inorganic binder may be dried to form the layer 12.

A coating layer 14 is thus formed by coating the slurry over the surface of the binder containing layer 12. The surface condition of the core matrix 10 is improved by the provision of the coating layer 14 to give a smooth surface. The mold reaction between the mold and the molten metal at the casting step is also improved by the provision of such a coating layer 14, with a further advantage that the high temperature strength of the mold core is further increased.

After being coated with the slurry, the mold core matrix 10 is then dried, for example, at a temperature of 28° C. and at a relative humidity of 50%, by air flowing at a rate of 1 m/sec for about 3 hours. A large size core may be additionally dried by microwave heating for about 10 minutes. This step 106 may be omitted in case where the surface of the product need not be smooth.

Figure 2D:
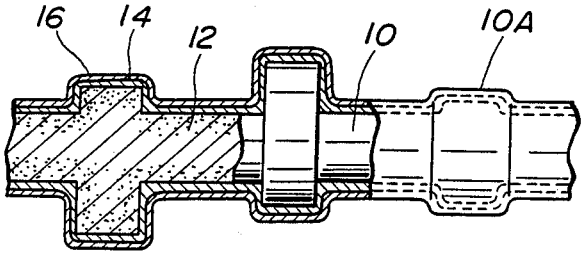
Figure 2:
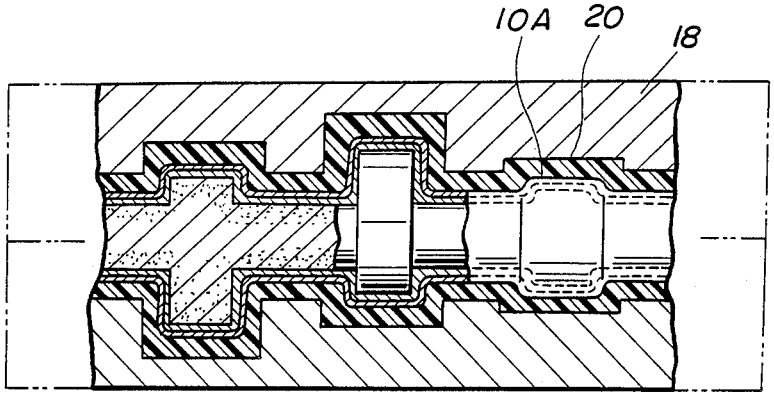
Figure 2:
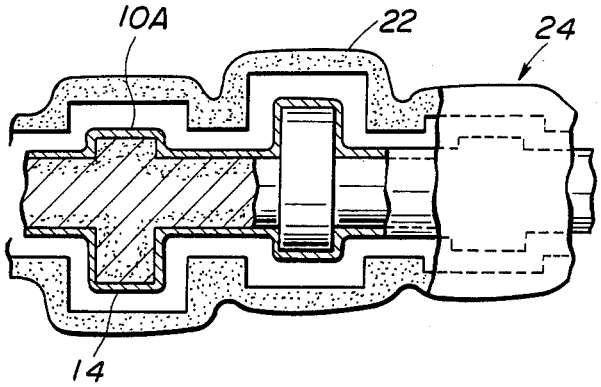
Figure 2:
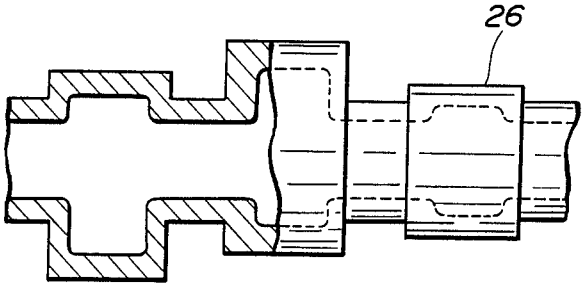

The dried core matrix 10 is then coated with a wax, preferably paraffin wax (Step 108; FIG. 2D))). The core matrix 10 coated with the coating layer 14 is dipped in a molten paraffin wax maintained at 80° C. to 90° C. for about 10 minutes to form a wax layer 16 over the surface of the coating layer 14 so that the crumbling or fall-off of the coating layer 14 is prevented. The wax layer 16 also serves to increase the strength of the core to prevent a breakdown thereof during the transportation operation and to prevent the core from absorbing moisure during the storage time. It is further expected that the environment during the subsequent baking step is maintained at a reducing atmosphere by the presence of wax to increase the strength of the baked core mold.

The finished mold core 10A shown in FIG. 2(D) is prepared through the aforementioned steps of impregnating the core matrix 10 with the binder to form a binder containing layer 12, and then forming successively the coating layer 14 and the wax layer 16 over the exterior surface of the layer 12.

The mold core 10A is fixed in position by any conventional means within a lost model molding mold 18. A material for forming a lost model, such as a wax or foamed polystyrene, is injected into the cavity defined by the core 10A and the lost model molding mold 18, whereby a lost model 20 is molded (Step 110; FIG. 2(E)). The lost model 20 is then removed from the lost model molding mold 18 and a refractory material is coated over the periphery of the lost model 20 by repeating for plurality of times the operation cycle each including the step of dipping the lost model in a slurry container (Step 112) and the step of applying with stucco particles (Step 114), whereby a refractory material layer 22 having a desired thickness is formed (FIG. 2(F)). After sufficiently drying the refractory material layer 22 (Step 116), the lost wax model 20 is allowed to vanish by dewaxing (Step 118). Then the refractory material layer 22 is baked (Step 120). During this dewaxing step, the wax layer 16 of the core 10A is also removed, whereupon the coating layer 14 is exposed over the surface of the core 10A. However, the wax impregnating into the core 10A is left.

Figure 3:
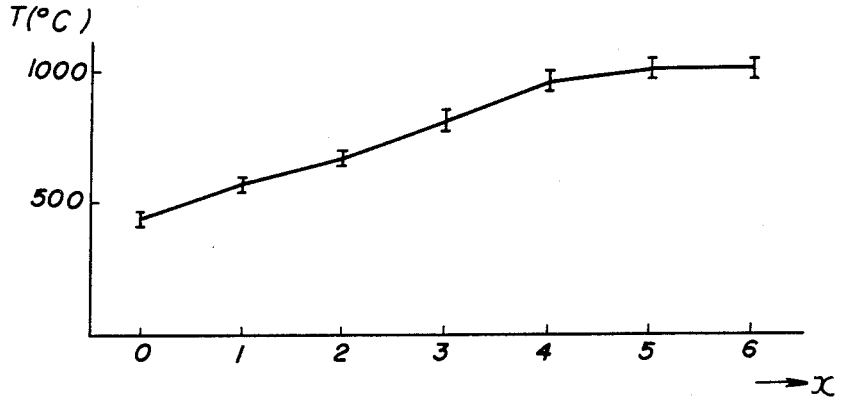
FIG. 3 is a graphic representation showing the baking temperature controlled in accordance with a preferred embodiment of the invention.

The baking temperature is controlled as illustrated in FIG. 3. In FIG. 3, the abscissa represents the distance x from the inlet of a baking furnace within which the mold is conveyed, and the ordinate represents the temperature T (°C.) at respective positions of the baking furnace. As shown in FIG. 3, the temperature within the baking furnace is increased continuously or stepwisely from the inlet ($x=0$) to the outlet. The length of the baking furnace varied depending on the size of the mold baked therein. In the illustrated embodinent wherein a mold for producing a tubular product is prepared, the length of the baking furnace is about 24 meters and the mold is baked preferably for about 2.5 hours. During this baking step, the refractory material layer 22 is maintained at a reducing atmosphere since the wax impregnating into the core mold 10A burns to form reducing gases. Accordingly, the core mold 10A is baked in a reducing atmosphere. As the result, the organic binder contained in the core mold 10A is not lost too rapidly to allow gradual impregnation of the heat resisting inorganic binder into the core mold 10 during the baking step. The strength of the core mold 10 is increased as the gradual impregnation of the inorganic heat resisting binder. If the core mold 10 is baked in the atmosphere, i.e. in an oxidizing atmosphere, the strength of the resultant baked mold is extremely lowered. Such an inconvenient decrease in strength of the baked core mold is prevented by simultaneous baking of the core mold 10 within the shell mold maintained in a reducing atmosphere.

As described above, the mold core 10A is baked simultaneously with the baking of the refractory material layer 22 of the shell mold. As the result, a ceramic shell mold 24 is produced containing therein the core matrix 10 having a layer 12 impregnated with the binder and being covered with the coating layer 14 (see FIG. 2(F)).

A molten metal is cast into the cavity of the ceramic shell mold 24, i.e. the cavity defined by the interior wall of the refractory material layer 22 of the shell mold 24 and the exterior surface of the coating layer 14 of the mold core 10A (Step 122). After cooling, the exterior shell mold is removed (Step 124) and then the core matrix 10 and the coating layer 14 are removed (Step 126). The core matrix 10 and the coating layer 14 are removed by the step of removing the major portion of the core by means of physical vibration or impact. The subsequent step is immersing the cast metal in a caustic soda solution or hot melt caustic soda to dissolve the remaining portions of the core matrix and the coating layer. A final cast product 26 is thus produced as shown in FIG. 2(G). An important advantage of the process of this invention is that the core matrix may be readily demolished to be removed easily at the step 126, since the depth of the layer 12 impregnated with the binder is spontaneously controlled to an appropriate degree so that the central portion of the core matrix 10 is not impregnated with the binder.

Although the core matrix 10 has the heat resisting binder and the slurry which are applied by the separate steps 104 and 106, respectively for impregnating with the heat resisting binder (Step 104) and for coating the slurry (Step 106) in the aforementioned embodiment, the Steps 104 and 106 may be comined to treat the core matrix 10 at a single step. This may be done by using a slurry containing the same binder that is used in the Step 104 and by increasing the time for dipping the core matrix 10 in the slurry container to allow the binder to be impregnated into the core matrix 10 to a desired depth.

Although the present invention has been described by referring to an embodiment wherein the mold core prepared by the invention is combined with a ceramic shell mold, it should be apparent to those skilled in the art that the mold core of the invention may also be conveniently used in other investment casting process, such as solid mold process. In such a case, the exterior mold may be prepared by a process similar to the process for preparing the core mold. By baking the exterior mold also within a reducing atmosphere, the strength of the exterior mold can be increased to have a satisfactory strength.

According to the present invention, a heat resisting binder is impregnated from the surface of the core matrix molded from a kneaded compound mainly composed of an aggregate and an organic binder to form a layer containing a heat resisting binder, the core matrix being then coated with a wax layer, and thereafter the mold core is baked simultaneously with the baking of the exterior mold. The organic binder admixed to the aggregate increases the strength of the core matrix before baking, and the presence of a layer impregnated with the heat resisting binder improves the strength of the core mold at the high temperature environments which are encountered during the mold baking step and the molten metal casting step. The mold core need not be sintered prior to its combination with the exterior shell mold.

According to another important feature of this invention, the impregnation of the heat resisting binder into the core matrix is limited to an appropriate depth so that the mold core can be easily demolished or collapsed and thus easily removed after use.

It is expected that the core mold is baked in a reducing atmosphere since the wax layer covering the core mold burns to generate reducing gases, which contributes increase in strength of the baked mold core. The wax layer also prevents a fall-off of the coating layer and increases the strength of the mold core so that breakdown of the core during the transportation is prevented. Further, the wax layer prevents the mold core from absorbing moisture during the storage thereof.

Due to exclusion of the step of sintering the mold core, the total process can be simplified to improve production efficiency and to lower the cost, with an additional merit that the dimensions of the mold core may be more easily controlled. It is also possible to prepare a mold core made of materials which are the same as the materials used in the exterior shell mold so that the core mold and the exterior shell mold have essenstially the same thermal expansion coefficient, to accurately control the dimensions of the finished cast product. This is particularly convenient when a large-scale cast product is produced.

What is claimed is:

1. A process for preparing an investment casting mold comprising the steps of:

(a) kneading an aggregate with an organic binder;

(b) casting the kneaded compound composed of the aggregate and the organic binder into a core molding mold to be solidified therein to produce a core matrix;

(c) impregnating a heat resisting binder from the surface of said core matrix;

(d) coating said core matrix impregnated with said heat resisting binder at said step (c) with a wax to form a core mold;

(e) placing said core mold in position within a lost model molding mold and then injecting a lost model forming material into said lost model molding mold to form a lost model surrounding said core mold;

(f) coating a slurry and stucco particles alternately for plural times over said lost model to form a refractory layer which is then dried;

(g) allowing said lost model to vanish so as to obtain a final mold; and (h) baking said final mold composed of core mold and said refractory layer simultaneously.

2. The process according to claim 1, wherein said aggregate is mainly composed of siliceous sand.

3. The process according to claim 1, wherein said organic binder is a phenolic resin.

4. The process according to claim 1, wherein said baking step (h) is effected under a temperature control so that the baking temperature is raised gradually as the baking proceeds.

* * * * *